US011077341B2

(12) United States Patent
Lytle

(10) Patent No.: US 11,077,341 B2
(45) Date of Patent: Aug. 3, 2021

(54) BALANCED SET OF GOLF CLUBS

(71) Applicant: Michael F. Lytle, Phoenix, AZ (US)

(72) Inventor: Michael F. Lytle, Phoenix, AZ (US)

(73) Assignee: LYTLE RESEARCH AND DEVELOPMENT CORPORATION, Phoenix, AZ (US)

( * ) Notice: Subject to any disclaimer, the term of this patent is extended or adjusted under 35 U.S.C. 154(b) by 0 days.

(21) Appl. No.: 15/810,111

(22) Filed: Nov. 12, 2017

(65) Prior Publication Data

US 2018/0185718 A1 Jul. 5, 2018
US 2021/0178232 A9 Jun. 17, 2021

Related U.S. Application Data

(63) Continuation-in-part of application No. 15/049,035, filed on Feb. 20, 2016, now Pat. No. 9,814,950.

(51) Int. Cl.
*A63B 53/00* (2015.01)
*A63B 53/04* (2015.01)
*A63B 60/42* (2015.01)

(52) U.S. Cl.
CPC ..... *A63B 53/047* (2013.01); *A63B 60/42* (2015.10); *A63B 53/005* (2020.08); *A63B 2053/0491* (2013.01); *Y10T 29/49826* (2015.01)

(58) Field of Classification Search
CPC ..... A63B 53/047; A63B 60/42; A63B 2053/0491; A63B 2053/005; Y10T 29/49826
See application file for complete search history.

(56) References Cited

U.S. PATENT DOCUMENTS 3,984,103 A * 10/1976 Nix ..... A63B 53/00 473/291
4,679,791 A * 7/1987 Hull ..... A63B 53/00 473/201
4,784,390 A * 11/1988 Horgen ..... A63B 53/00 473/409
4,811,950 A * 3/1989 Kobayashi ..... A63B 53/04 473/335
4,971,321 A * 11/1990 Davis ..... A63B 53/00 473/287
5,228,688 A * 7/1993 Davis ..... A63B 53/00 473/290
5,333,859 A * 8/1994 Teramoto ..... A63B 53/00 473/290
9,814,950 B2 * 11/2017 Lytle ..... A63B 53/047

* cited by examiner

*Primary Examiner* — Stephen L Blau
(74) *Attorney, Agent, or Firm* — Dickinson Wright PLLC

(57) ABSTRACT

A set of golf clubs with a plurality of at least two combinations of different lengths of a minimum of three golf clubs in each combination having progressive lofts that are matched to provide identical swing characteristics requiring unique loft and club length progressions to provide consistent yardage spacing between irons within a combination and between combinations. Each club in a combination is further defined by the shaft having an equal length; an identical swing weight, an identical grip weight and an identical head weight.

5 Claims, 5 Drawing Sheets

BALANCED SET OF GOLF CLUBS

RELATED APPLICATIONS

The present application is a continuation in part of U.S. patent application Ser. No. 15/049,035, filed Feb. 20, 2016 tilted titled Balanced Set of Iron Type Golf Clubs, which is now U.S. Pat. No. 9,814,950.

BACKGROUND OF THE INVENTION

The present invention relates to golf clubs and in particular to a balanced set of golf clubs.

The game of golf is played by a wide variety of different players having different physical and golf swing characteristics. Because of these differences traditionally conventional sets of golf clubs are balanced using a number of variables in order to fit the particular physical and swing characteristics of particular golfers. Such variables include things such as length of the club, the weight of the club, the flexibility of the shaft, the shape and size of the club head and the swing weight of the club.

In the traditional method of balancing golf clubs, each golf club has its own unique length, balance point, lie angle, loft, weight and other subtleties that make each club different and require a golfer to adjust and learn as many as eight to ten different golf swings in order to make a repeatable golf swing for each club. For example, the clubs designed to hit a ball the farthest distances are longer than the clubs designed to hit the golf ball shorter distances. A shortcoming of this design is that the longer clubs are typically harder to use to make solid contact with the golf ball, primarily because the swing path or arc is longer.

Prior art golf clubs that have the same swing weight, same mass and same length are known in the art. It is a common practice to use wedges of the same length in a set of golf clubs. An attempt to create a balanced set of golf clubs is disclosed in U.S. Pat. No. 3,984,103 to Nix which is directed to a matched golf club set wherein all clubs in a class of either irons or woods have equal shaft length, equal lie angle, equal swing weight and equal total weight.

The Tommy Armour Company marketed a complete set of clubs that are the same size under the trade name Equalizers where each club in the set was the length of a conventional 6 iron. Single length irons have also been marketed under the trade name 1 Irons. Simpleton Golf is presently marketing a set of golf clubs formed of two combinations of clubs where each club in the combination is essentially the same except for the loft angle and loft progressions. While the merits of a single swing mechanic for an entire set appeared promising, the diverse specifications of 6 iron length for the high lofted irons and wedges and a six iron length for the longer and mid irons was found to be too difficult for most golfers to control and effectively use to hit consistent golf shots. Neither the Nix patent nor the prior art products considered the use of a set formed of a minimum of two combinations of identical clubs or the unique loft and club length progressions needed to produce the yardage spacing found in traditional golf club sets.

Another patent of interest is U.S. Pat. No. 5,624,329 to Schneebeli that shows matched putter and chipper golf clubs that are identical in weight, length, balance and feel.

SUMMARY OF THE INVENTION

Specific shaft selection for a golf club creates variances in the loft and length relationship. The unique loft and club length progressions, that provide consistent yardage spacing for golf shots within and between the clubs and within and between combinations of golf clubs, are affected by the specific shaft selection. The flexibility of a particular shaft and the shaft kick point, where the shaft bends, can alter the trajectory of a ball struck by a golf club and can therefore alter the distance traveled by the golf ball struck by the particular golf club. This inconsistency necessitates the need for greater loft variability for clubs both within and between combinations of clubs and possible length variability between combinations. Additionally, when utilizing a minimum of combinations, the desired length between the same combinations is greater than length needed when using more than a minimum of combinations to accommodate the length range of typical golf sets.

The present invention is a set of a golf clubs having a plurality of at least two combinations of clubs. Each combination includes at least three golf clubs having different loft values. Each of the clubs in a combination has the same length that is a different length than the length of the clubs in other combinations of the set. The difference in club lengths between successive combinations of clubs may vary depending upon the size of the set and the number of combinations used to make up the set. Although the length difference can be any value preferably it is no less than 0.45 inches and no more than 2.55 inches.

Each club in a combination is matched to provide identical swing characteristics. The individual combinations of clubs in the set have unique loft progressions between the clubs whereby each of the combinations is characterized by clubs in any particular combination where the loft difference between the first, lowest lofted club and the second, higher lofted club in the same combination is no more than the loft difference between the second, higher lofted club and the third, highest lofted club in the same combination. Each individual combination of clubs also has loft differences between individual clubs that are no less than the loft differences between the same consecutive individual clubs of another combination as the length of the clubs in combinations increase. Each club is further defined by having an identical club head weight and having an identical swing weight.

Each combination has at least three or more golf clubs of the same length and varying lofts designed to hit a golf ball different distances. The higher lofted clubs are designed to hit a golf ball a shorter distance than the lower lofted clubs, requiring unique loft and club length progressions to provide consistent yardage spacing within and between the clubs within and between combinations. This approach in golf club set design is somewhat similar to the traditional progression of lengths within a set of conventional design but differs in that the clubs of the present invention are separated into combinations of similar clubs thus requiring a majority of golfers to learn no more than three swing parameters as opposed to the 8 to 10 different swings required by a traditional set of clubs each having different lengths.

Another feature of the set of golf clubs of the present invention is that the loft difference between the highest lofted club in a combination and the lowest lofted club in an adjoining higher lofted combination is no more than the loft difference between consecutive individual clubs in the prior less lofted combination and is no more than the loft difference between consecutive individual clubs in an adjoining higher lofted combination.

The present set of golf clubs has a loft difference between the highest lofted club in a combination and the lowest lofted club in an adjoining higher lofted combination that is no more than the loft difference between the highest lofted club in the same adjoining higher lofted combination and the lowest lofted club in the next adjoining higher lofted combination.

In addition, the clubs include a shaft and a grip at the upper end of said shaft and each of the clubs in a combination has the same length, swing weight and club head weight.

Each individual golf club of the combination of golf clubs in accordance with the present invention is made within the following tolerances maintaining essentially identical characteristics. The designated loft of each individual club may vary plus or minus 1.0 degrees. The designated length may vary plus or minus 0.275 inches. The designated swing weight may vary plus or minus 1.0 swing weight points or 50 gram inches. The designated club head weight may vary plus or minus 5.0 grams.

The range of parameters for multiple combinations of different lengths of three or more consecutive golf clubs within a set is preferably the following: the lofts of a club head defining the ball striking face are between 15 and 65 degrees; the length of a club is between 30 and 40 inches; the swing weight of a club is between 5350 gram/inches and 6350 gram/inches; the club head weight is between 220 grams and 370 grams.

An entire set may comprise up to a maximum of 12 consecutive clubs lofted from 15 degrees to 65 degrees. The golf club combinations within a particular set have a minimum of three consecutive clubs.

Among the objects of the present invention is the provision of a set of golf clubs having at least two or more combinations of golf clubs having the same length, same weight and same swing weight in each of the combinations of clubs in the set.

Still another object is the provision of a set of golf clubs formed of at least two combinations of individual clubs having unique loft difference between the clubs of a same combination.

A further object is the provision of a set of golf clubs formed of at least two combinations wherein the loft differences between individual clubs in a combination that are no less than the loft differences between the same consecutive individual clubs of another combination as the length of the clubs in combinations increase.

These and other objects will become apparent with reference to the drawings and specification of the present application.

DESCRIPTION OF THE PREFERRED EMBODIMENTS

Figure 1:
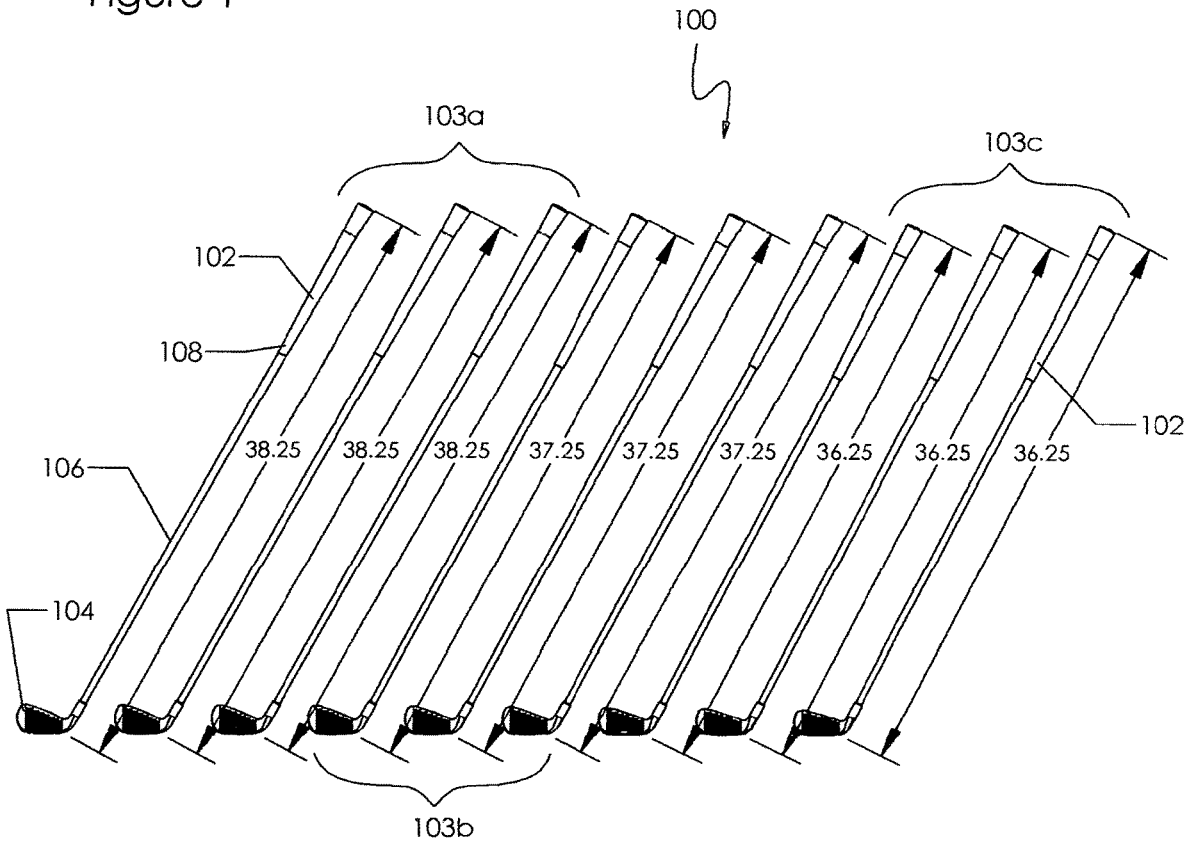
FIG. 1 is an elevational view of a set of golf clubs made in three combinations of three clubs in accordance with present invention.

Referring to the drawings, FIG. 1 discloses a set of golf clubs 100 in accordance with the principles of the present invention. The set includes individual clubs 102 in three adjoining combinations 103 as represented by a first combination 103*a* of three clubs 102, a second combination 103*b* of a middle three clubs 102 and a third combination 103*c* of a last three clubs 102. Each golf club 102 of the set includes a club head 104, shaft 106 and grip 108.

The overall length of each club 102 preferably is between 30 and 40 inches, the exact length being determined by the physical size and overall dimensions of a particular golfer who will use the clubs. In the embodiment shown, each club 102 of a first combination 103*a* of the set 100 is made the same length of 38.25 inches within a tolerance of 0.275 inches. The adjoining second combination 103*b* of three clubs 102 has a length of 37.25 inches also within a tolerance of 0.275 inches. The third combination 103*c* of three clubs has a length of 36.25 with a 0.275 inch tolerance.

A set of golf clubs using multiple combinations will utilize a difference in length for the individual clubs in that combination than the length of clubs for adjoining combinations. In a typical set using more than a minimum of two combinations, a first combination 103*a* has a length of 38.25 inches plus or minus 0.275 inches. An adjoining combination 103*b* of higher lofted clubs uses a length of 37.25 inches plus or minus 0.275 inches.

The length of the clubs 102 in a third adjoining combination 103*c* of still higher lofted clubs is 36.25 inches plus or minus 0.275 inches. As with the first two combinations 103*a* and 103*b*, the difference in length of the clubs of combination 103*c* and the clubs 102 of the previously adjoining combination 103*b* is one inch, however, it will be appreciated that the length difference of clubs in the various combinations may be any suitable length depending upon the size of the set of clubs. Preferably this length difference will be as little as 0.45 inches and no greater than 2.55 inches.

For example, a set of golf clubs using a minimum of two combinations to make the set preferably will utilize a difference in length as great as 2.55 inches for adjoining combinations. A set having three or more combinations preferably will use a shorter length difference of clubs between combinations and may be as little as 0.45 inches.

Each club 102 in a combination 103*a*, for example, is matched to provide identical swing characteristics and the set 100 is provided with unique loft progressions between the clubs in the combinations. The individual clubs 102 in any of the combinations are formed with a loft difference between the individual clubs 102 in any particular combination where the loft difference between the first, lowest lofted club and the second, higher lofted club in the same combination is no more than the loft difference between the second, higher lofted club and the third, highest lofted club in the same combination.

The loft difference between the first and second clubs in a combination can be the same as or less than the loft difference between the second higher lofted club and the third higher lofted club in the same combination. For example, the clubs 102 in the first combination 103*a* all have a loft difference of 3.0 degrees between each of the clubs 102. The clubs 102 in the second combination have a loft difference of 3.5 degrees and the clubs 102 in the third combination have a loft difference of 4.0 degrees.

Another feature of the set 100 of golf clubs 102 of the present invention is that each individual combination of clubs has loft differences between individual clubs in that combination that are no less than the loft differences between consecutive individual clubs of another combination 103, as the length of the clubs 102 in individual combinations increase.

The loft differences between individual clubs in a single combination can be the same as or more than the loft differences between consecutive individual clubs of another combination, as the length of the clubs 102 in individual combinations increase. For example, combination 103*c* has individual clubs 102 that have the shortest length of 36.25 inches and have a loft difference of 4 degrees between the individual clubs 102 in that combination 103*c*. Likewise combination 103*b* that has a length of 37.25 inches for each individual club 102 has a lesser loft difference of 3.5 degrees between the individual clubs 102 in that combination. Combination 103*a* that has the longest length of 38.5 inches for each club 102, has the least loft difference of 3.0 degrees between the individual clubs 102 in the combination 103*a*.

The swing weight of each club 102 in any of the individual combinations 103 of clubs is essentially the same and may vary plus or minus 1.0 swing weight points or 50 gram inches and may vary between combinations. Overall the swing weight is between 5350 gram/inches and 6350 gram/inches depending upon the physical characteristics and the individual swing of the golfer using the set of clubs 100.

increasing in a heel 112 to toe 114 direction. The heel 112 and toe 114 heights are constant in size for each club 102 in a combination 103 within a set 100. The heel 112 and toe 114 heights are measured at a location equidistant from the centerline of the club head 104 on the ball striking face 110. The heights may be varied to achieve a desired overall weight.

Figure 3:
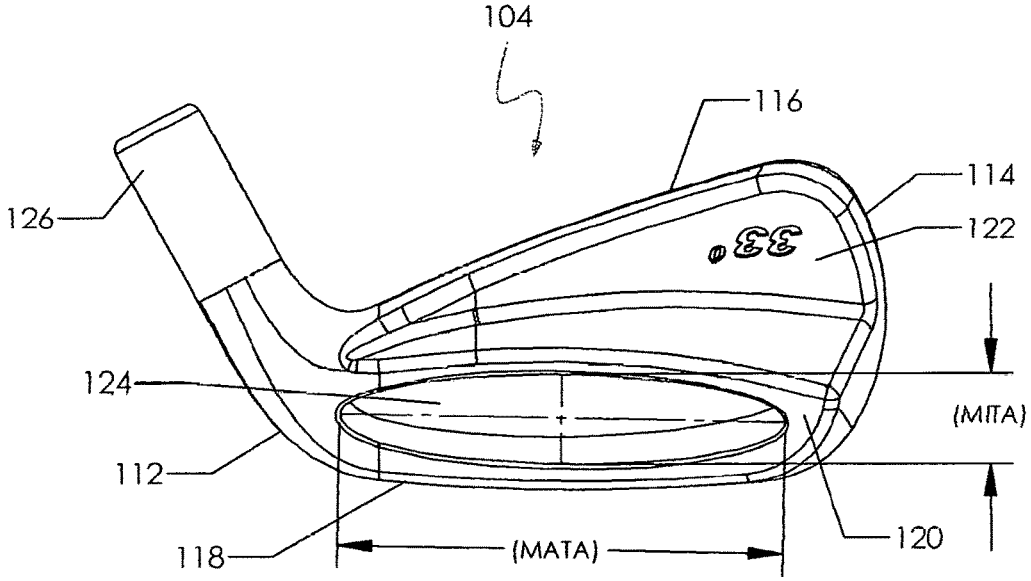
FIG. 3 is a rear elevational view of a single golf club head of the invention.
Figure 4:
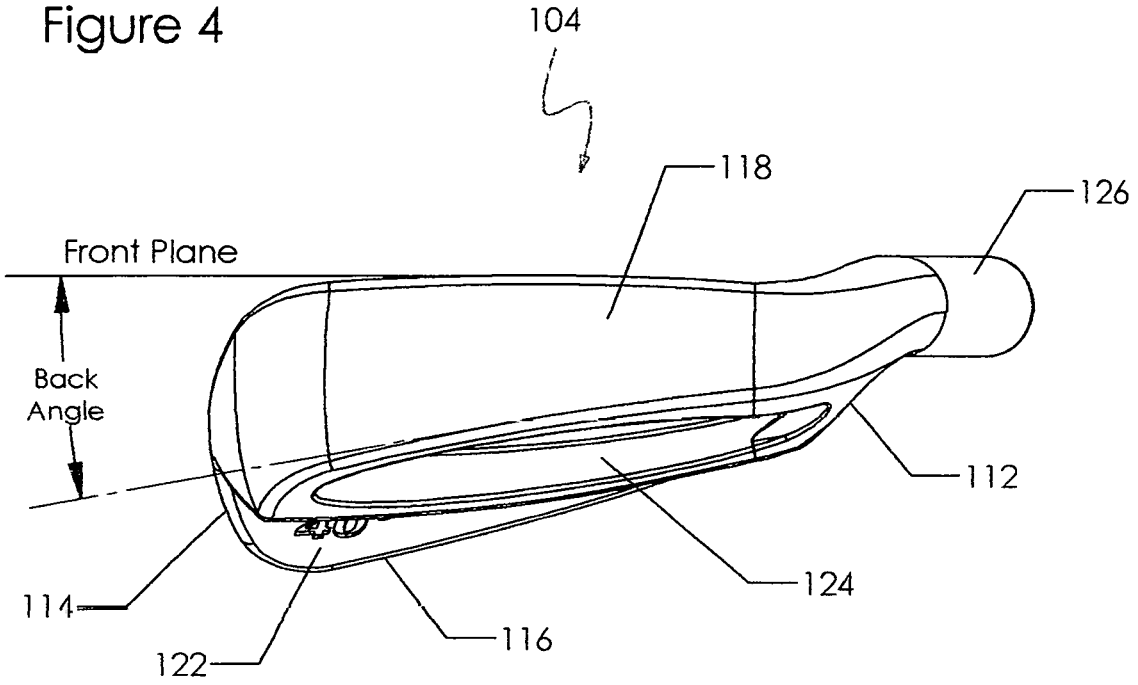
FIG. 4 is a bottom view of FIG. 3.
Figure 5:
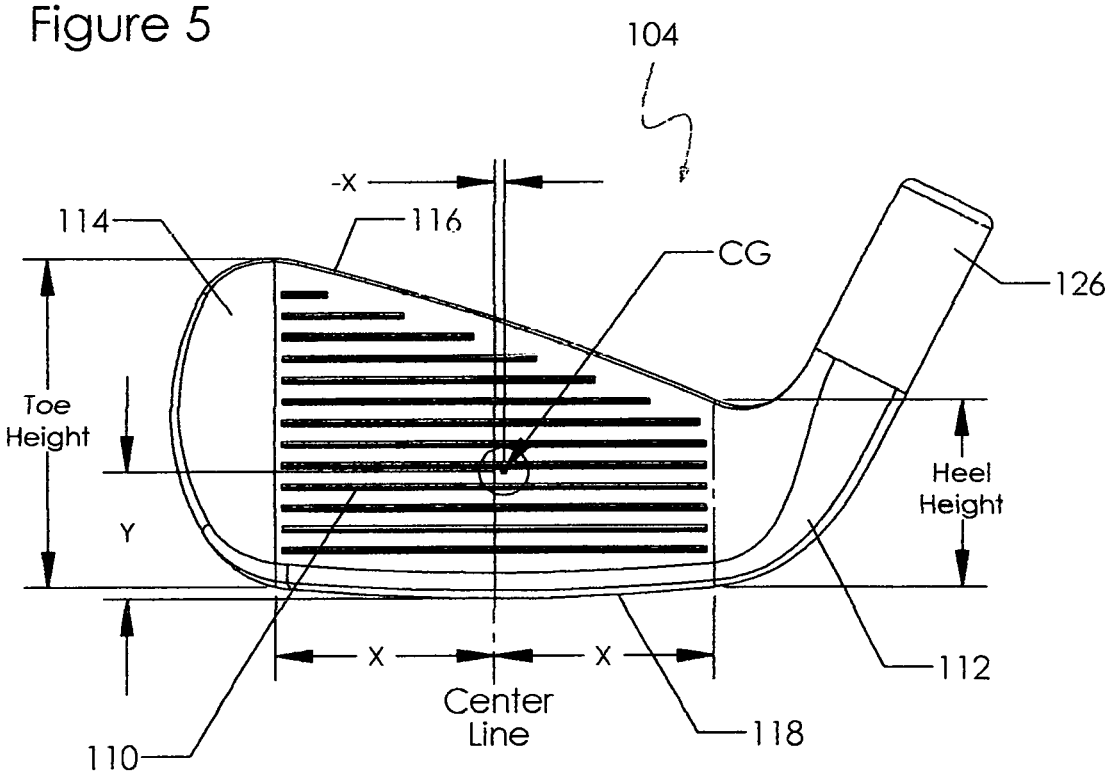
FIG. 5 is a front elevational view of the club head of FIG. 3.
Figure 6:
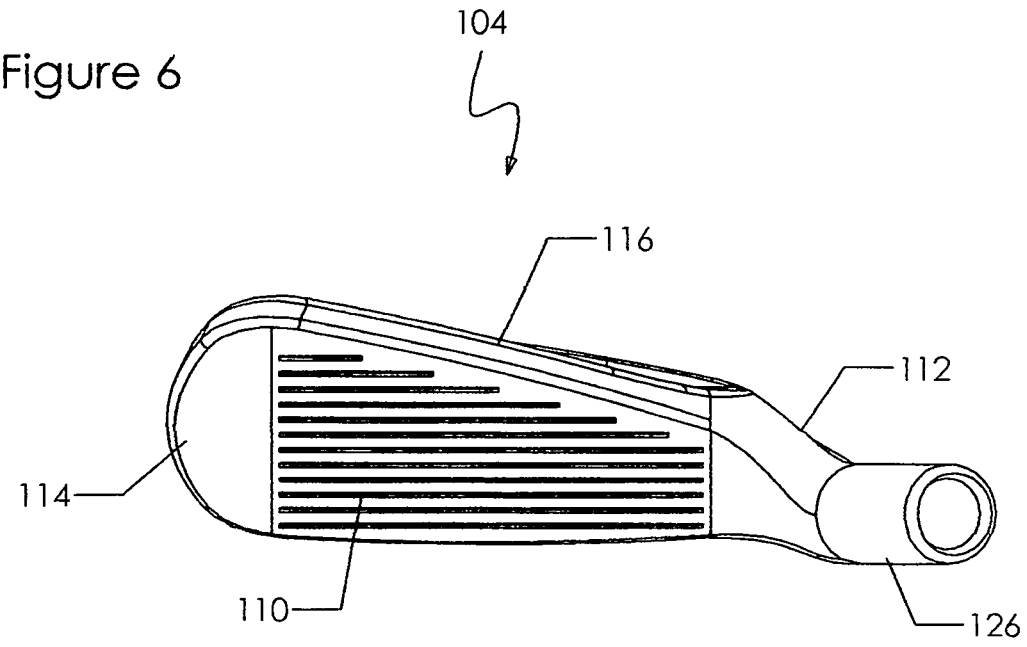
FIG. 6 is a top plan view of the of FIG. 3.
Figure 7:
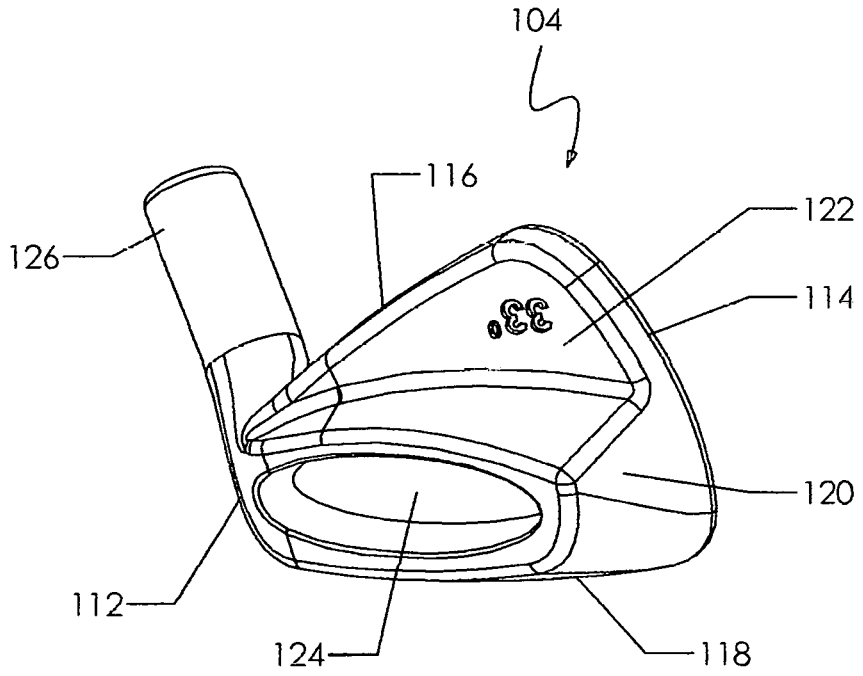
FIG. 7 is a toe perspective view of the club head of FIG. 3.
Figure 8:
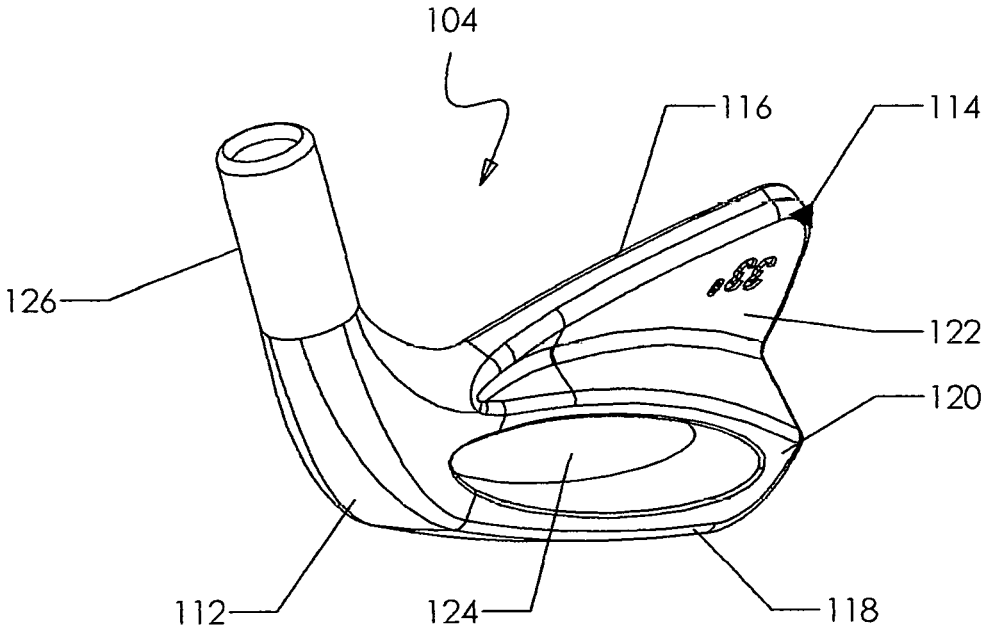
FIG. 8 is a heel perspective view of the club head of FIG. 3.
Figure 9:
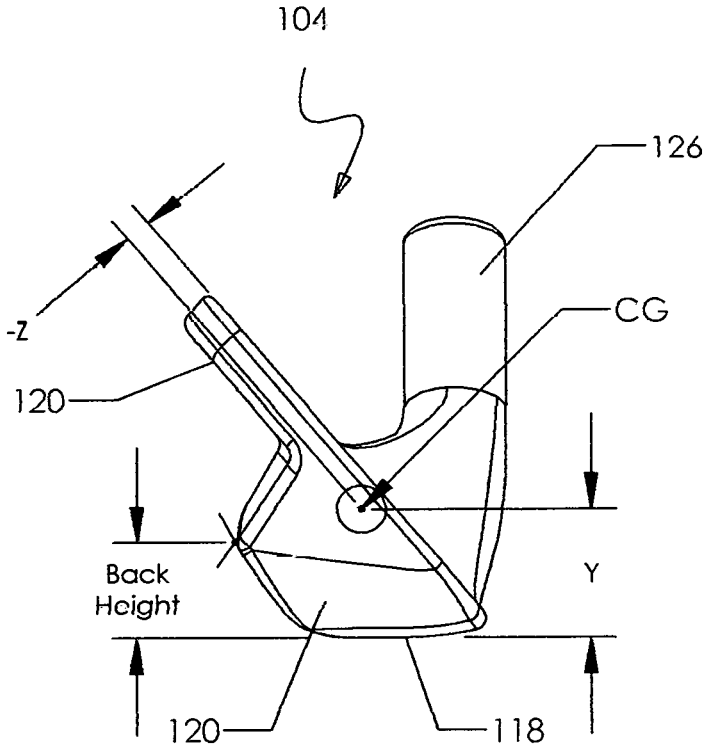
FIG. 9 is a toe end view of the club head of FIG. 3.

A rear cavity 124. is formed in the rear weight 120. The club head 104 further includes a hosel 126 for connection to a shaft 106 as shown in FIG. 1. The cavity 124 is measured by the major transverse axis, MATA, and minor transverse axis, MITA, as shown in FIG. 3. The size of the cavity 124 is varied to achieve the desired weight.

Each club head 104 is made with all the club head parameters as described above precisely controlled using conventional forging, casting, CNC milling, 3D printing or other manufacturing techniques.

The set includes at least two combinations 103 formed of a plurality of at least three golf clubs 102, with progressively increasing lofts, each having a club head 104, a shaft 106 and grip 108 to provide identical swing characteristics when using essentially the same golf swing.

The following table discloses typical measurements of various parameters of three combinations 103 of golf clubs 102 the make up a set 100. The table quantifies the center of gravity, CG, the toe and heel heights, the club head weight, the grip weight, the shaft weight, the shaft length, the total length. the cavity parameters, the back angle and the back height of the club head.

TABLE 1

| | | 20.5 | 23.5 | 26.5 | 29.5 | 33 | 36.5 | 40 | 44 | 48 |
|---|---|---|---|---|---|---|---|---|---|---|
| CG X Axis | Inches | 0.05 | 0.05 | 0.04 | 0.04 | 0.04 | 0.03 | 0.05 | 0.05 | 0.05 |
| CG Y Axis | Inches | 0.71 | 0.72 | 0.72 | 0.70 | 0.70 | 0.69 | 0.67 | 0.66 | 0.64 |
| CG Z Axis | Inches | −0.19 | −0.17 | −0.17 | −0.16 | −0.15 | −0.14 | −0.13 | −0.12 | −0.11 |
| Head Weight | grams | 252.0 | 252.0 | 252.0 | 268.0 | 268.0 | 268.0 | 285.0 | 285.0 | 285.0 |
| Grip Weight | grams | 50.00 | 50.00 | 50.00 | 50.00 | 50.00 | 50.00 | 50.00 | 50.00 | 50.00 |
| Shaft Weight | grams | 125.0 | 125.0 | 125.0 | 121.0 | 121.0 | 121.0 | 117.0 | 117.0 | 117.0 |
| Shaft Length | inches | 37.07 | 37.07 | 37.07 | 36.07 | 36.07 | 36.07 | 35.07 | 35.07 | 35.07 |
| Total Length | inches | 38.25 | 38.25 | 38.25 | 37.25 | 37.25 | 37.25 | 36.25 | 36.25 | 36.25 |
| Major Tran Axis (MATA) | Inches | 2.48 | 2.48 | 2.48 | 2.48 | 2.48 | 2.48 | 2.48 | 2.48 | 2.48 |
| Minor Tran Axis (MITA) | Inches | 0.55 | 0.55 | 0.55 | 0.55 | 0.55 | 0.55 | 0.55 | 0.55 | 0.55 |
| Cavity Area | Sq In | 1.07 | 1.07 | 1.07 | 1.07 | 1.07 | 1.07 | 1.07 | 1.07 | 1.07 |
| Back Angle | degrees | 6.25 | 6.25 | 6.25 | 6.25 | 6.25 | 6.25 | 6.25 | 6.25 | 6.25 |
| Back Height | Inches | 0.61 | 0.61 | 0.60 | 0.56 | 0.55 | 0.54 | 0.50 | 0.49 | 0.48 |
| Toe Height | Inches | 2.01 | 2.01 | 2.01 | 2.13 | 2.13 | 2.13 | 2.44 | 2.44 | 2.44 |
| Heel Height | Inches | 1.06 | 1.06 | 1.06 | 1.18 | 1.18 | 1.18 | 1.30 | 1.30 | 1.30 |

The club head weight is the same for each club 102 of any of the individual combinations 103 of the set 100 and overall is between 220 grams and 370 grams and may vary plus or minus 5.0 grams.

Figure 2:
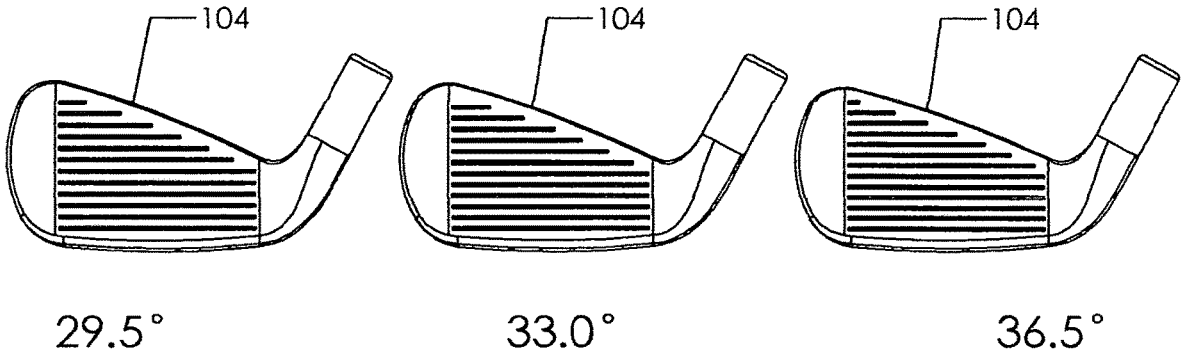
FIG. 2 is an elevational view of three golf club heads forming a single combination of clubs of the present invention.

FIG. 2 shows three club heads 104 of a typical combination 103 having different lofts of 29.5 degrees, 33.0 degrees and 36.5 degrees but with identical physical characteristics as described below.

FIGS. 3 through 8 show a typical club head 104 of a generally conventional design used in the golf set 100 of the present invention. It will be appreciated that all club heads 104 within the set 100 vary primarily in loft angle throughout the set 100 in a conventional manner. Each club head 104 includes a ball striking face 110, heel 112, toe 114, top ridge 116, bottom sole 118, and a rear peripheral weight 120, having a rear face 122, formed at an angle between said striking face 110 and rear face 122 the angle progressively The present invention is not limited to the specific golf club heads disclosed and it is equally applicable to club heads of various designs and shapes. It will also be appreciated that other modifications, including but not limited to the preferred embodiment, can be made to the combinations of golf clubs disclosed above in keeping within the spirit and scope of the invention as described in the following claims.

The invention claimed is:

1. A set of a golf clubs having a plurality of at least two combinations of clubs; each combination of said set having a different length than the length of other combinations of said set; the club length difference between successive combinations of clubs being no less than 0.66 inches and no more than 2.33 inches; each combination including a minimum of three golf clubs; each of the minimum of three golf clubs in a combination defined as having the same length and are matched to provide identical swing characteristics;

said combinations of said set having unique loft progressions between the clubs in the individual combinations, whereby each of the combinations is characterized by a loft difference between the individual clubs in any particular combination where the loft difference between the first, lowest lofted club and the second, higher lofted club in the same combination is no more than the loft difference between the second, higher lofted club and the third, highest lofted club in the same combination; each individual combination of clubs further defined as having loft differences between individual clubs that are no less than the loft differences between the same consecutive individual clubs of another combination as the length of the clubs in combinations increase; and, each club in any combination having an identical club head weight and each club having an identical swing weight.

2. The set of golf clubs of claim 1 wherein each individual golf club includes a club head formed of a ball striking face, upper surface, bottom, toe, heel and rear surface including an integral rear weight; each individual golf club including a shaft and a grip at the upper end of said shaft.

3. The set of golf clubs of claim 1 further defined by the height of said toe and the height of said heel in individual irons is the same for each individual club within each combination.

4. The set of golf clubs of claim 1 wherein the loft difference between the highest lofted club in a combination and the lowest lofted club in an ad joining, higher lofted combination is no more than the loft difference between consecutive individual clubs in the prior less lofted combination and is no more than the loft difference between consecutive individual clubs in an adjoining, higher lofted combination.

5. The set of golf clubs of claim 4 defined as having more than two combinations wherein the loft difference between the highest lofted club in a particular combination and the lowest lofted club in an adjoining, higher lofted combination is no more than the loft difference between the highest lofted club in the same adjoining, higher lofted combination and the lowest lofted club in the next adjoining, higher lofted combination.

* * * * *